United States Patent [19]

Allen

[11] Patent Number: 4,535,730

[45] Date of Patent: Aug. 20, 1985

[54] ROCKER ENGINE

[76] Inventor: Dillis V. Allen, 1080 Nerge Rd., Suite 205, Elk Grove Village, Ill. 60007

[21] Appl. No.: 214,082

[22] Filed: Dec. 8, 1980

[51] Int. Cl.[3] ..... F02B 75/04

[52] U.S. Cl. ..... 123/78 F; 123/48 B

[58] Field of Search ..... 123/78 R, 78 E, 78 F, 123/48 R, 48 B

[56] References Cited

U.S. PATENT DOCUMENTS

| | | | |
|---|---|---|---|
| 1,112,832 | 10/1914 | Pierce | 123/78 F |
| 1,786,423 | 12/1930 | Cady | 123/78 F |
| 1,901,263 | 3/1933 | Ruud | 123/78 F |
| 1,978,058 | 10/1934 | Peterson | 123/78 E |
| 3,511,102 | 5/1970 | Brandes | 123/78 R |
| 3,633,552 | 1/1972 | Huber | 123/48 B |
| 3,686,972 | 8/1972 | McWhorter | 123/78 E |
| 4,111,164 | 9/1978 | Wuerfel | 123/78 E |
| 4,173,202 | 11/1979 | Crise | 123/78 E |
| 4,380,972 | 4/1983 | Parkins | 123/78 F |

*Primary Examiner*—Parshotam S. Lall
*Assistant Examiner*—W. R. Wolfe

[57] ABSTRACT

An internal combustion engine that has automatic stroke length control and independent compression ratio control. The engine is of the reciprocating piston type using conventional valving and intake and exhaust manifolding. Stroke length control is effected by a first planetary gear set driven in oscillation by the piston and a clutch mechanism which selectively locks the gear set to oscillate through either a long arc length for the long stroke or a short arc length for short stroke. Compression ratio adjustment, as well as piston top dead center phasing during and after clutching, is effected by a second planetary gear set driven in oscillation by the piston and a servo-motor for varying the phase of oscillation of the second planetary gear set to shift the top dead center position of the piston as desired independently of the length of stroke of the piston.

12 Claims, 9 Drawing Figures

12
30
31
32
33
34
35
36
37
38
39
41
42
43
44
46
47
49
50
52
53
55
56
58
60
61
62
16
17
18
20
22
25
27
1.
58'
60'
61'
62'

95
55
71
65
76
13
73
77
72
78
67
79
78
16
20
32
TDCC
60°
69
64
81
82
66
59
58
BDCC 96
146
111
SHORT STROKE COMPARATOR
SHORT STROKE PHASE REF. GENERATOR
105
108
114
115
112
LONG STROKE COMPARATOR
109
LONG STROKE PHASE REF. GENERATOR
106
116
117
GATE
120
143
102
DRIVER
130
GATE
121
144
SERVO MOTOR 65
GATE
122
154
103
131
GATE
123
155
DRIVER
BAND 74 DRIVER
128
149
140
141
150
148
CLUTCH 69 SOLENOID
CLUTCH 67 SOLENOID
32.4° PHASE SHIFT GENERATOR
147
152
SPEED SENSOR
99
SEQUENCER
A. LONG TO SHORT SEQ.
B. SHORT TO LONG SEQ.
98
100

SHORT STROKE SHIFT & PHASE

LONG STROKE PHASE

LONG STROKE SHIFT

LONG STROKE PHASE

ROCKER ENGINE

BACKGROUND OF THE INVENTION

Reciprocating piston and crank internal combustion engines having a four phase thermodynamic cycle have enjoyed wide use for the last three-quarters of a century not only as prime movers of vehicles but also in a wide variety of industrial applications. This wide acceptance is due to their reliability, low cost compared to alternative prime movers, and better torque vs. RPM characteristics.

The reciprocating piston and crank engine develops its maximum torque near the upper end of the engine's range. With the use of a suitable transmission, this high torque at high speed characteristic can be converted advantageously to high torque at a variety of speeds. These engines generally have a fixed piston displacement for each revolution of the crank and under high speed and low load conditions, this results in an excessive consumption of fuel.

Attempts have been made to reduce this problem by reducing the number of operable cylinders in response to increases in output speed. For example, it has been proposed in an eight cylinder engine after the engine reaches a certain speed that the valves associated with two or four of the cylinders be locked closed preventing intake or exhaust from these cylinders. While this may achieve a desired displacement reduction, it does not effect any significant reduction in fuel consumption because of the energy required to reciprocate and rotate the "closed down" pistons, rods and crank arms.

Variable displacement motors of the rotary annularly arrayed piston type have found considerable success as pumps or motors in the art of hydrostatic drives, but have not attained any significant success as internal combustion engines. These devices generally include a cylinder block, having annularly arrayed cylinders therein, that slideably engages a fixed valve plate having inlet and outlet ports. Pistons slideable in the cylinder block engage a tilted cam sometimes referred to as a "swashplate" that provides the reciprocating movement of the pistons as the cylinder block rotates. The displacement of the motor is varied by changing the angle of the swashplate and can easily be reduced to zero when perpendicular to the axis of the cylinder block, a feature which is desirable in many applications.

One of the disadvantages in using this rotary reciprocating piston motor as a variable displacement internal combustion engine is that as the displacement is varied, the compression ratio varies dramatically. The compression ratio is defined as CR=Stroke Length+Clearance Volume/Clearance Volume, where clearance volume is the volume of the cylinder with the piston in top dead center. Internal combustion engine fuels have, for a given fuel, a limited range of combustability, referred to as octane rating. The use of these fuels in the rotary reciprocating piston engine results in either under compression or over compression of the fuel, and this results in incomplete combustion and unwanted compression ignition. This inefficient burning of the fuel outweighs any benefits from the displacement varying capability of the rotary cylinder block motor.

Another, and related, problem in engines of the reciprocating piston and crank type (not the rotary cylinder block engine) is that their compression ratios are generally fixed or difficult to vary. This, of course, is because the crank throw or cylinder head position cannot be readily changed. In today's atmosphere of new petroleum fuels and petroleumalcohol fuels, it is desirable that an internal combustion engine be capable of using a variety of fuels efficiently. To do this, however, it is necessary to have an engine with a variable compression ratio, and thus far no practical engine of the reciprocating piston and crank type has been developed that achieves that end.

It is a primary object of the present invention to ameliorate the above problems, in internal combustion engines of the reciprocating piston and crank type.

SUMMARY OF THE INVENTION

In accordance with the present invention an internal combustion engine of the reciprocating piston and crank type is provided that has variable displacement as well as variable compression ratio—and both of these functions can be effected either simultaneously to maintain constant compression ratio as displacement changes or independently to vary compression ratio with changes in fuel octane.

Toward these ends, the present engine includes four cylinders having pistons that reciprocate under a four phase thermodynamic cycle using known fuel injection intake and exhaust valving techniques. The pistons reciprocate a rocker-crank mechanism, or more particularly two rocker crank mechanisms, one for each pair of pistons. The rocker-crank mechanism is a four-bar linkage device that converts oscillating motion of an input shaft to rotary unidirectional motion of a counter output shaft.

According to the present invention a two stage planetary gear drive is interposed in the drive train between the pistons and the rocker-crank mechanism for both varying the piston stroke length and independently of stroke length varying the piston top dead center position. The piston drives an input shaft in oscillation that in turn oscillates an input gear carrier in the first stage planetary gear set. The carrier has planet gears that react against an angularly adjustable but normally stationary ring gear and drives an output sun gear that is also the input gear of the second stage planetary gear set. A servomotor, under the control of a microprocessor varies the top dead center position of the piston by incrementally shifting the ring gear in either direction.

The sun gear input to the second stage planetary gear set engages planets on an output gear carrier whose planets react against a dual mode ring gear. The output carrier oscillates the input crank of the rocker-crank mechanism that has a unidirectional output driving the main engine output shaft. A brake and clutch mechanism under the control of the microprocessor selectively locks the ring gear against oscillation so that the sun gear oscillates through a wide arc or locks it to the carrier so that the sun gear oscillates through a narrow arc to achieve the long stroke or short stroke control.

The microprocessor responds to a predetermined increase in engine speed, for example $n_x$, where $n_x=n_{max}/2.3$ when $n_{max}$ is maximum engine speed, to shift from long stroke to short short stroke. The kinematic effect of this is to lower the top dead center position of piston after the short stroke clutching. The microprocessor, to compensate for this top dead center lowering, responds to a phase encoder on the piston driver shaft and compares actual top dead center to a stored top dead center program, to control the first stage ring gear servo-motor to raise the piston top dead center upwardly, even above the long stroke top dead center position to maintain the same compression ratio in short stroke as in long stroke.

As the engine decelerates when the pistons are in short stroke, the microprocessor in response to a predetermined engine speed and the piston phase encoder, increases piston stroke and adjusts the top dead center position of the piston. The microprocessor in anticipation of shifting, controls the servo-motor for the first stage ring gear to lower top dead center position approximately 32 degrees, and thereafter it controls the second stage clutch and brake to increase planetary oscillation angles and thereby increase stroke length to long stroke. The previously retarded top dead center position of the piston is then raised by the microprocessor control of the first stage ring gear servo-motor to the preprogrammed position.

The microprocessor is programmed with both long stroke and short stroke top dead center positions. The phase encoder on the piston driven input shaft applies signals to a comparator in the microprocessor that compares signals representing the programmed top dead center position with the actual top dead center signals from the encoder and derives differential control signals to the first stage ring gear to bring the top dead center to the programmed values. In shifting from long stroke to short stroke, the microprocessor activates the programmed long stroke top dead center program and control simultaneously with the stroke change function. In shifting from short stroke to long stroke the microprocessor activates short stroke shifting only after it retards piston top dead center, and thereafter raises piston top dead center to the programmed value for long stroke.

The preprogrammed values of the top dead center positions are stored in the microprocessor and may be varied to increase or decrease the compression ratio of the engine. This function is independent of the microprocessor's control over the clutching and phasing functions except that during phasing the top dead center portions during or after stroke length change is returned to the preprogrammed position. The top dead center control may be reprogrammed by varying the values of the stored top dead center positions in position storage memories in short stroke and long stroke phase reference generators. For example, if the engine is using a low octane fuel, or a lower combustability fuel, the stored value of top dead center may be reduced and this reduces compression ratio to burn the lower octaine fuel more effectively and completely.

DETAILED DESCRIPTION OF THE PREFERRED EMBODIMENT

Figure 1:
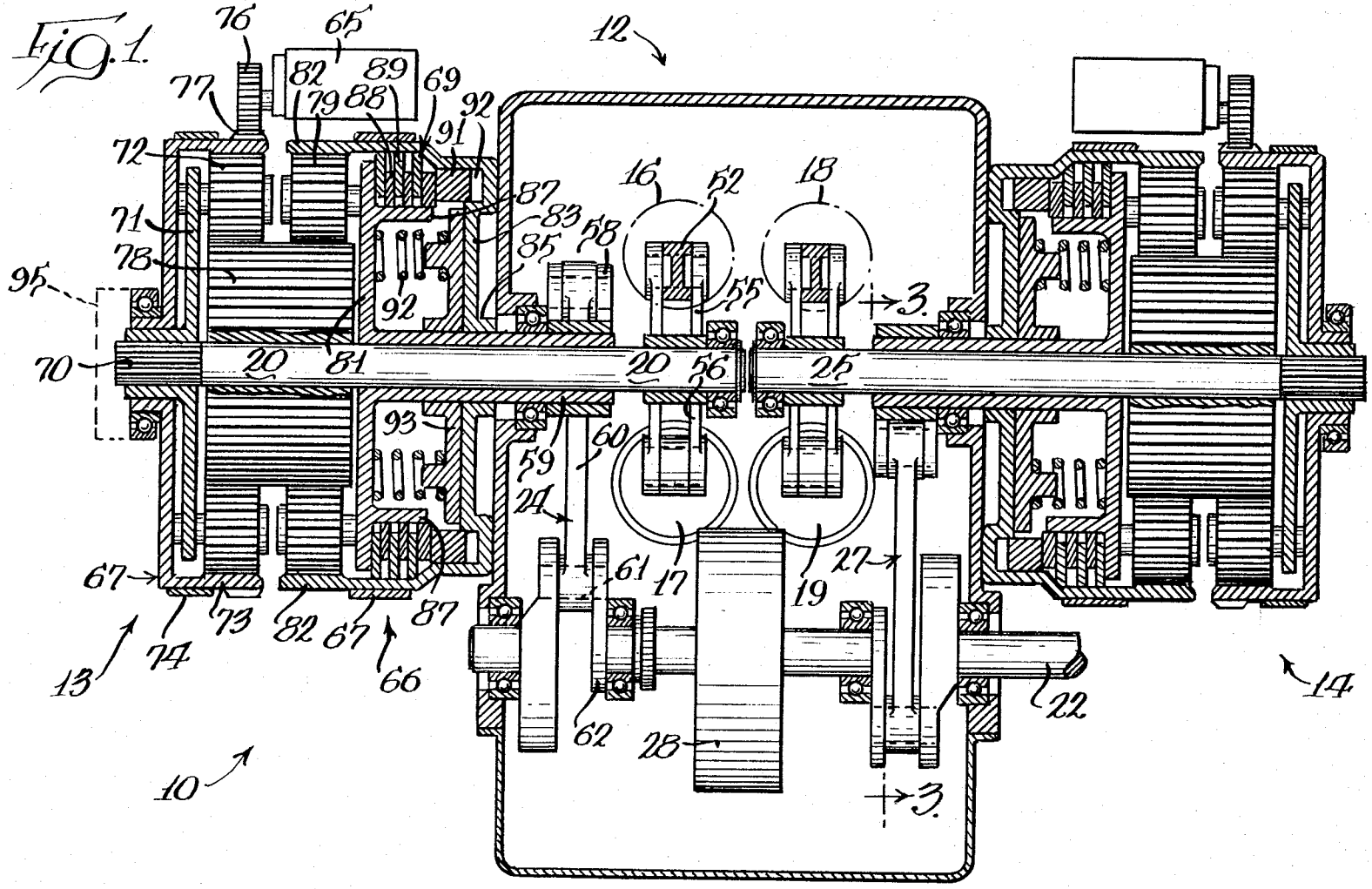
FIG. 1 is a longitudinal section through the present internal combustion engine.
Figures 2, 3:
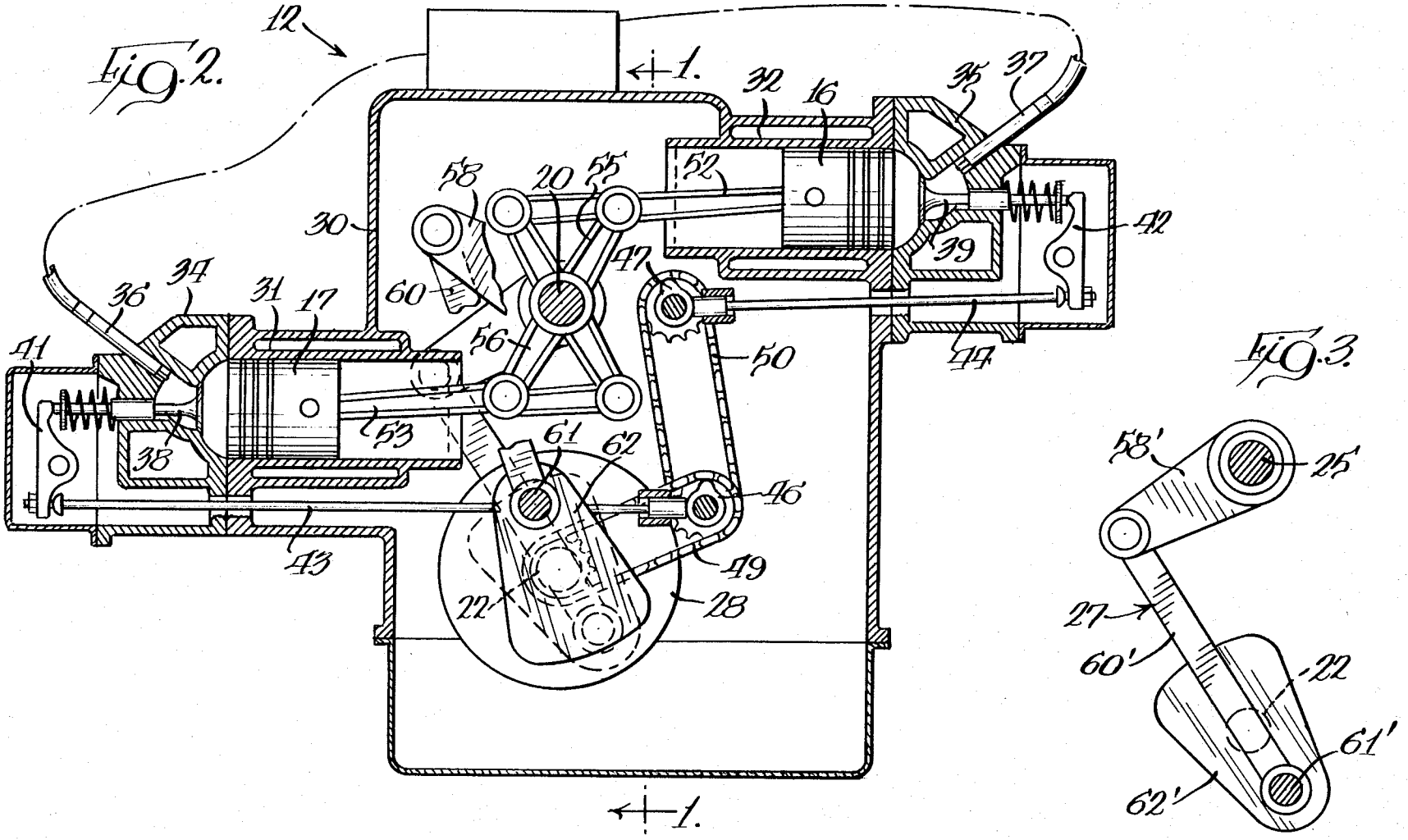
FIG. 2 is a cross-section taken generally along line 2—2 of FIG. 1 illustrating the opposed piston and cylinder arrangement.
FIG. 3 is a cross-section taken generally along line 3—3 of FIG. 1 illustrating the rocker crank mechanism.

Referring to the drawings and particularly FIGS. 1 and 2 thereof, an internal combustion engine 10 is illustrated and it is seen to be a four cylinder opposed piston design with the opposed pistons being tied together in phase. Engine 10 generally includes a central cylinder block section 12 flanked by opposed two stage planetary gear drives 13 and 14. Pistons 16 and 17 oscillate input shaft 20 and drive main output shaft 22 through two stage planetary gear drive 13 and a rocker crank mechanism 24. Pistons 18 and 19 oscillate input shaft 25 and drive output shaft 22 through two stage planetary gear drive 14 and a rocker crank mechanism 27. A flywheel 28 is carried by output shaft 22 between the rocker-crank mechanisms 24 and 27 to assist in producing the inertial rotation of shaft 22 necessary to pass the rocker crank mechanisms 24 and 27 through their zero force positions.

Pistons 16 and 17, along with rocker and crank mechanism 24, are 180 degrees out of phase with respect to pistons 18 and 19 and rocker-crank mechanism 27. Otherwise, the left and right halves of the engine 10 illustrated in FIG. 1 are identical so that the following description will be applicable to both halves of the engine even though not specifically referenced to both.

Viewing FIG. 2, the central section 12 of the engine is illustrated including a main cylinder block 30 having four cylinders formed therein, two of which are illustrated in this figure, identified generally as cylinder 31 and opposed cylinder 32. Cylinders 31 and 32 are closed by cylinder heads 34 and 35 that carry fuel injectors 36 and 37, respectively, and inlet valving 38 and 39. Similar outlet valving is positioned adjacent inlet valving 38 and 39, although not shown in in FIG. 2, in conventional fashion. The valves 38 and 39 are driven by rocker arms 41 and 42 which in turn are pivoted by push rods 43 and 44 which are reciprocated by cams 46 and 47 driven by the output shaft 22 through timing chains 49 and 50. The manifolding, fuel injection, and inlet and outlet valving thus far described are conventional four phase or four cycle internal combustion engine technology.

It should be understood, however, that the pistons 16 and 17 are phase locked together and fire on alternate downstrokes of the pistons. More specifically, assuming the pistons 16 and 17 to be in their top dead center positions illustrated in FIG. 2 and fuel is admitted to chamber 52, this fires driving piston 16 downwardly oscillating input shaft 20 in a counterclockwise direction which pulls piston 17 also downwardly on its fuel intake stroke. On the upward or return stroke of the pistons 16 and 17, piston 16 will be in its exhaust stroke and piston 17 will be in its compression stroke and the power for this upward portion of the stroke is provided by the pistons 18 and 19 which are 180 degrees out of phase with respect to the pistons 16 and 17. On the downstroke of the pistons 16 and 17, fuel in chamber 53 associated with piston 17 will fire, driving piston 17 downwardly oscillating shaft 20 in a counterclockwise direction and driving piston 16 downwardly in its fuel intake stroke.

Pistons 16 and 17 are connected to oscillate input shaft 20 through rods 52, 53, pivotally connected at one end to the pistons and at their other ends to crank arms 55 and 56 connected together and keyed to input shaft 20. Thus as the pistons 16 and 17 fire on alternate cycles, they oscillate the input shaft 20. The oscillating motion of the input shaft 20 is transmitted through the two stage planetary drive 13 to oscillate crank arm 58 in rocker-crank mechanism 24. The rocker-crank mechanism 24 converts the oscillating motion of crank 58 into unidirectional rotational motion of output shaft 22. Rocker-crank mechanism 24 includes crank 58 which is driven by output sleeve 59 of the two stage planetary gear set 13. Sleeve 59 supports in part input shaft 20 but is freely rotatable relative thereto. Rocker-crank mechanism 24 also includes an intermediate drive link 60 driven by crank 58, pivotally connected to a crank pin 61 of a crank 62 formed on the output shaft 22. Crank arm 58 is longer than crank 62 and link 60 is sufficiently long to effect the proper known kinematics for four bar linkage rocker-crank mechanisms.

The two stage planetary gear drive 13, as shown in FIG. 1, is seen to generally include a first stage planetary gear set 64 controlled by servo-motor 65 and a second stage planetary gear set 66 controlled by brake 67 and carrier clutch 69. The first stage 64 is driven by oscillating input shaft 20 which in turn drives the second stage planetary gear set 66 that oscillates output sleeve 59 and the rocker-crank mechanism 24.

Figure 4:
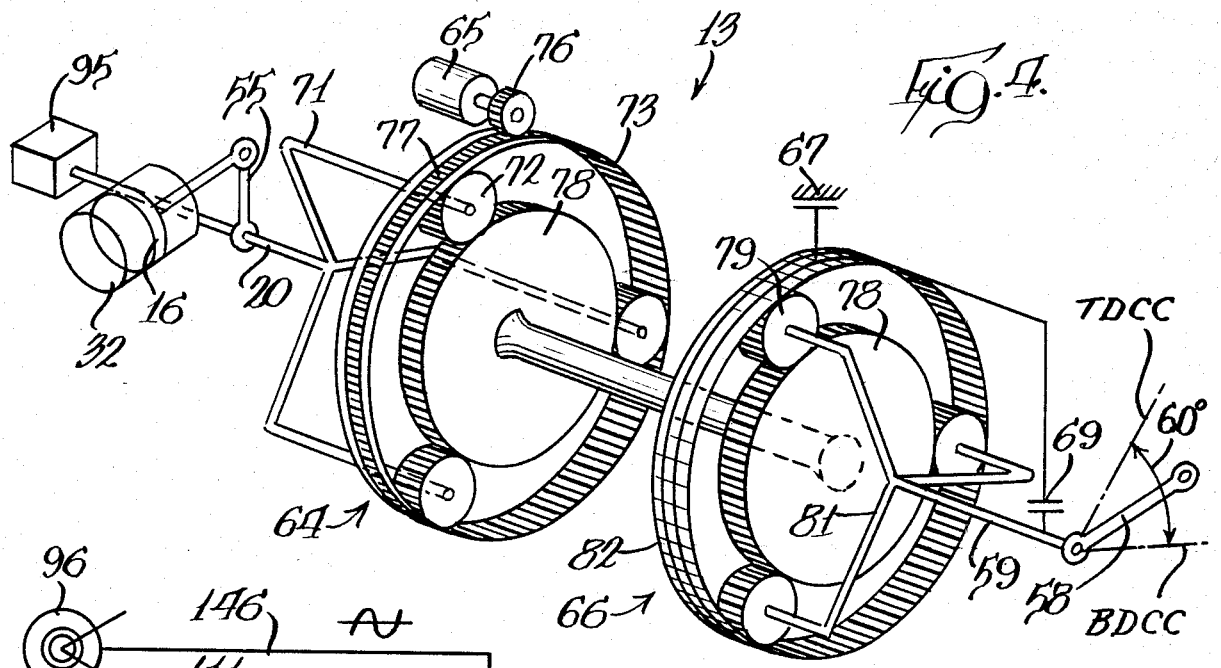
FIG. 4 is a schematic exploded diagram of a single cylinder driving a crank through the two stage planetary gearing.

Reference should be made to FIG. 4 where the planetary gear drive 13 is shown in schematic form driven by a single piston 16 (for purposes of example) and driving the rocker crank mechanism crank 58. It should be understood, however, that the first stage 64 and the second stage 66 are reversed in FIG. 4 compared to the physical location in FIG. 1, but functionally they are the same.

Returning to FIG. 1, the outboard end 70 of input shaft 20 is splined and is drivingly connected to a planet carrier 71 in the first stage that rotatably carries three equally spaced pinions 72. Pinions 72 engage teeth on an internal cup-shaped ring gear 73 that is normally locked in a fixed position by selectively actuable brake band 74. Upon release of the brake band 74, the angular position of ring gear 74 is incrementally adjusted by servo-motor 65 which has an output gear 76 engaging pinion gear teeth 77 formed on the outer surface of ring gear 73. After the angular position of ring gear 73 has been adjusted by servo-motor 65, band brake 74 is again actuated to lock the ring gear 73 in its adjusted position. The planet gears 72 engage and drive a sun gear 78 mounted for free rotation on the input shaft 20. The driving force on the sun gear 78 is provided by the pinion gears 72 reacting against the normally stationary ring gear 73 as the carrier plate 71 is oscillated by input shaft 20.

The sun gear 20 is common to both first and second stage planetary gear set 64 and 66. In the second stage planetary gear set 66, sun gear 78 drives three equally spaced pinion gears 79 rotatably carried by output carrier plate 81. Carrier plate 81 is formed integrally with output sleeve 59 and thus is the output element of the second stage planetary gear set 66 as well as the entire planetary gear drive 13.

Planet pinions 79 engage a cup-shaped ring gear member 82 having a radially inwardly directed flange 83 and an annular boss portion 85 mounted on and freely rotatable with respect to the output sleeve 59. Ring gear 82 is selectively locked in position by a solenoid operated band brake 67.

The output carrier plate 81 has an annular axial extension 87 that carries a plurality of clutch plates 88 that extend between similar clutch plates 89 on ring gear 82 and which are clamped together by a hydraulically actuable annular piston 91 seated in an annular recess 92 formed in the ring gear member 82, all of which form part of the clutch 69. A plurality of annularly arrayed coil compression springs 92 are positioned between the carrier plate 81 and a spring seat plate 93 which is fixed to piston 91 and urges the piston to its inactive position upon deactuation of clutch 69. Upon the supply of hydraulic fluid to recess 92 through suitable porting (not shown) piston 91 shifts to the left engaging the clutch plates 88 and 89 locking the ring gear 82 to the carrier 81 to oscillate the entire second stage planetary gear set 66 as a unit.

The size and number of gear teeth in both the first and second stage planetary gear sets 64 and 66 are identical. The following number of teeth and diameter ratios have been found acceptable —sun gear 6*x*, planet gears 2*x*, ring gears lO*x*.

Viewing FIG. 4 for a description of the mechanical operation of the planetary gearing 13, it should be understood that the length of arcuate motion of the crank arm 58 is fixed, and in the example shown is 60 degrees. Not only is the angle of oscillation of the crank arm fixed, but also the phase of the angle of oscillation is fixed with respect to a fixed radius extending radially from output sleeve 59. Thus, at piston top dead center crank 58 will always lie on radius TDCC (top dead center crank) and at piston bottom dead center will always be positioned at BDCC indicated in FIG. 4. These kinematics are inherent from the geometry of the rocker-crank mechanism 24. This is important to visualize in the description of operation of the planetary gear set 13 and the stroke of the piston 16, since it is the only fixed reference angle in the engine and is used as a reference in the piston stroke diagrams shown in FIGS. 5, 6, 7 and 8.

In the long stroke mode of the planetary gear set 13, ring gear 73 is locked in position by brake 74 and ring gear 82 is locked to the housing by band brake 67. As the piston 16 is fired downwardly in its cylinder during one of its power strokes, crank 55 will oscillate through an arc of approximately 60 degrees which represents the long stroke mode of the present engine. This length of stroke is fixed by the oscillation of crank arm 58. The oscillating input shaft 20 drives pinion 72 in oscillation and as they react against stationary ring gear 73 provide an angle of oscillation of sun gear 78 greater than the long stroke oscillation of input shaft, i.e. 60 degrees in long stroke, as determined by the above-described gear ratios for the sun gear planets and ring gear. Sun gear 78 drives planets 79 in oscillation through an angle less than the angle of oscillation of the sun gear 78 since ring gear 82 is fixed in the long stroke mode. Since the size and number of teeth on the gears in the first stage planetary gear set 64 and the second stage planetary gear set 66 are the same, both crank arm 58 and piston crank arm 55 oscillate through an angle of 60 degrees in long stroke.

In the short stroke mode of the present engine, the first stage planetary ring gear 73 is normally fixed as it is in the long stroke mode, but in the second stage planetary gear set 66 the band brake 67 is released and the clutch 69 is actuated locking the second stage planetary elements to oscillate as a unit without differential motion through the same angle of oscillation as crank 55, i.e. 60 degrees. This reduces the angle of oscillation of sun gear 78 to 60 degrees compared to the long stroke mode in which it was significantly greater than 60 degrees, and causes planet carrier 71 and input shaft 20 to be constrained to oscillate through a reduced angle of oscillation of 36 degrees. Hence the length of stroke of the piston will be reduced from 3.0 inches in the long stroke mode to 1.653 inches in the short stroke mode.

Hence the long stroke and short stroke mode selections are effected solely by controlling the second stage planetary gear set 66.

The first stage planetary gear set 64 controls the top dead center position of piston 16 independently of the long and short stroke mode selection effected by second stage planetary gear set 66. That is, the first stage planetary gear set 64 merely changes the phase of the stroke of piston 16 without in any way varying its stroke length. Thus, as it raises and lowers piston top dead center it equally raises and lowers piston bottom dead center. To raise the top dead center position of piston 16, servo-motor 65 is actuated to rotate its output pinion 76 in a clockwise direction as viewed in Fig. 4. This rotates ring gear 73 in a counterclockwise direction rolling pinions 72 clockwise with respect to the instantaneous position of sun gear 78, causing carrier 71 to rotate the input shaft 20 incrementally clockwise, moving the stroke of piston 16 upwardly in its cylinder. Conversely, counterclockwise rotation of the servo-motor 65 will incrementally rotate input shaft 20 clockwise and lower the stroke of piston 16.

With the kinematics, and the control functions of the planetary gear drive 13 in mind, reference will now be made to FIGS. 5 to 8 for description of the stroke control and phasing functions of the planetary gear drive 13. It should be understood that as shown in FIGS. 5 to 8 that the top dead center (TDCC) and bottom dead center (BDCC) of the crank 58 form an angle somewhat greater than 60 degrees only to avoid confusion with long stroke top dead center and bottom dead center portions of the crank, but it should be understood that both the long stroke angle of crank 55 and the stroke of crank 55 are 60 degrees. The position of the crank arm 58 in top and bottom dead center are the same in each of FIGS. 5 to 8 and it is used as a reference in these views for the position of the piston. The various lines and angles depicted in FIGS. 5 to 8 actually represent the position of piston crank 55 rather than the piston 16 itself, but it should be understood that they are directly related. The terms TDCL' and BDCL' refer to transient end of stroke positions and similarly BDCS' or TDCS' refer to transient end of stroke positions in the short stroke mode.

Figure 5:
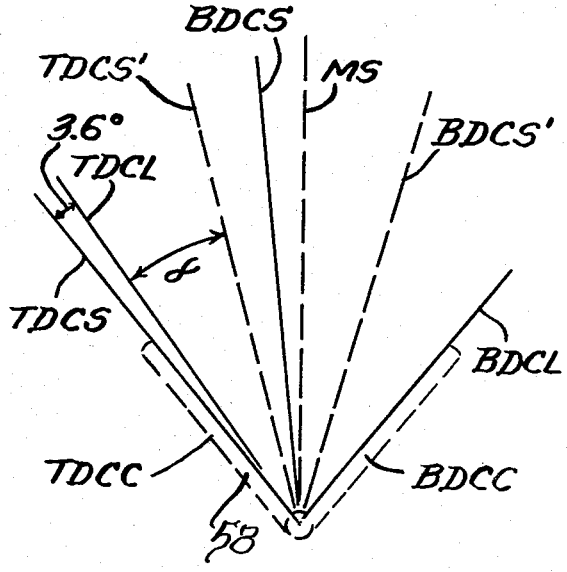
FIG. 5 is a phase and stroke length diagram for piston top and bottom dead center positions referenced with respect to one of the output crank arms illustrating the change in piston stroke during the shift between long stroke and short stroke.

Referring now to FIG. 5, taken in conjunction with the schematic diagram in FIG. 4, let it be assumed that the engine is initially operating in a low speed-long stroke mode with clutch 69 released and brake band 67 actuated, locking ring gear 82 against rotation. Piston crank 55 traverses an angle between top dead center long (TDCL) and bottom dead center long (BDCL) positions shown in FIG. 5. The microprocessor (described in more detail below) senses a predetermined increase in the speed of input shaft 22 and at a predetermined speed, deactuates band brake 67 and actuates clutch 69, locking the second stage planetary gear set 66 to oscillate as a unit with the crank 58. This shifts the crank stroke 55 to a top dead center position TDCS' and a bottom dead center position BDCS'. With the exception of clutching instantaneously at piston top dead center, the shifting from long stroke to short stroke will always retard the top dead center of the long stroke by some angle $\alpha$ indicated in FIG. 5. Since clutch 69 has some slippage during actuation, it is practically impossible to effect shifting instantaneously at piston top dead center so that there will as a practical matter always be some retardation. Thus in FIGS. 5 to 8 it is assumed in shifting from long stroke to short stroke and returning from short stroke to long stroke, that clutching and declutching is effected at midstroke for purposes of example, but it should be understood that shifting is slow compared to piston OPM (oscillations per minute), and that shifting may be completed anywhere in stroke from top dead center to bottom dead center. Midstroke clutching is reflected by the transient short stroke angle TDCS'- BDCS' illustrated in FIG. 5 being bisected by the "midstroke" line of the long stroke TDCL-BDCL. The angle $\alpha$ will vary from zero when shifting occurs at piston top dead center to a maximum of 24 degrees (60 degrees long stroke minus the 36 degree short stroke) when shifting occurs at piston bottom dead center.

A phase angle encoder 95, see FIG. 4, is mounted around input shaft 20 and provides signals to the microprocessor proportional to the top dead center position of crank 55 with respect to a fixed reference radius from shaft 20. The microprocessor receives signals from the encoder 95 and compares the signals with preprogrammed values of desired short stroke top dead center position TDCS and develops control signals for driving the servo-motor 65 in a direction to shift the transient top dead center position to the desired top dead center position. In shifting from long stroke to short stroke, the microprocessor control signal to servo-motor 65 rotates the output drive pinion clockwise raising the top dead center position of crank 55 until the top dead center signal from encoder 95 equals the preprogrammed short stroke piston top dead center, at which time the microprocessor shuts off servo-motor 65 and actuates band brake 74 immobilizing ring gear 73.

It can be seen from FIG. 5 that the top dead center position of the crank 55 in short stroke TDCS is advanced from the top dead center position of the crank 55 in long stroke TDCL by 3.6 degrees. This is to achieve a substantially constant compression ratio in both long stroke and short stroke modes and this value is determined by the preprogrammed values in the microprocessor for top dead center positions of the piston in short and long stroke. After raising the top dead center position, the piston then reciprocates in the short stroke mode between TDCS and BDCS. The engine is then operating in a short stroke high speed mode.

Figure 6:
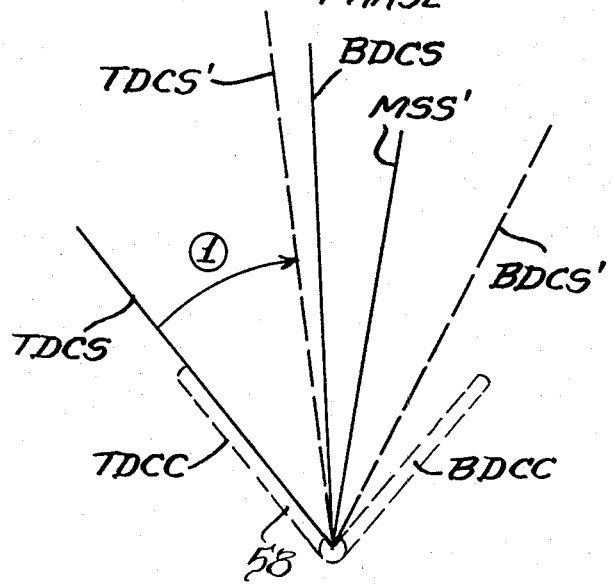
FIG. 6 is a phase and stroke length diagram for piston top and bottom dead center positions referenced with respect to one of the output crank arms illustrating the retardation of piston top dead center prior to shifting from short stroke to long stroke.

When in the short stroke high speed mode, the microprocessor senses a predetermined decrease in speed of output shaft 22, or alternatively a decrease in speed of an element of the load driven by output shaft 22, and usually at a speed substantially the same as the shifting speed from long stroke to short stroke, the microprocessor anticipates shifting from short stroke back to long stroke, and prepares for shifting by retarding piston top dead center short stroke TDCS by an angle of 32.4 degrees shown by the arrow ① in FIG. 6 to a transient top dead center position TDCS' indicated. This retardation is necessary to prevent the top dead center position after clutching, i.e. the transient top dead center position in longstroke TDCL', from advancing above the programmed top dead center long stroke, TDCL. Without retardation this would occur as a result of braking the second stage ring gear 66 by band brake 65, unless braking occurred instantaneously at piston top dead center which is practically impossible.

After the phasing or retarding function as described in connection with FIG. 6 is complete, the microprocessor controls actuators to release clutch 69 and clamp band brake 67 to ring gear 82 to lock it with respect to the housing. This increases the stroke length of crank 55 between the transient top dead center, TDCS', and transient bottom dead center, BDCL', i.e. to approximately sixty degrees. As in the example described above in connection with shifting from long stroke to short stroke in connection with FIG. 5, clutching from short stroke to long stroke is assumed to occur at piston midstroke in the short stroke represented by the line MSS' in FIG. 7. Of course clutching may occur anywhere in the transient short stroke of the piston and it should be understood that the midstroke clutching is merely exemplary in FIG. 7.

Figure 7:
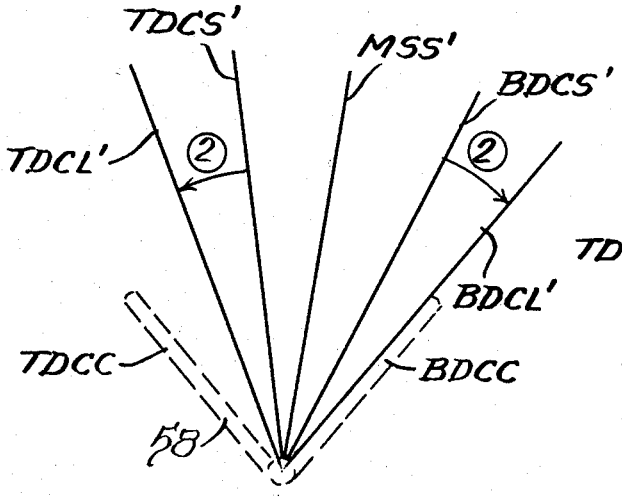
FIG. 7 is a phase and stroke length diagram for piston top and bottom dead center positions referenced with respect to one of the output crank arms illustrating the shift from short stroke to long stroke.
Figure 8:
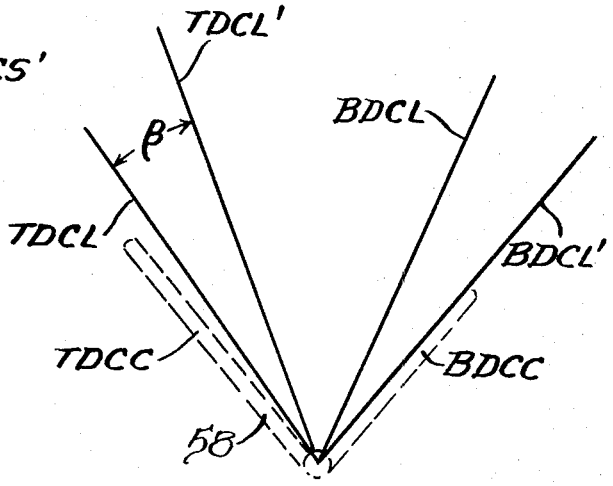
FIG. 8 is a phase and stroke length diagram for piston top and bottom dead center positions referenced with respect to one of the crank arms illustrating the advance of piston top dead center after shifting from short stroke to long stroke, and, FIG. 9 is a schematic diagram of a microprocessor for controlling the present internal combustion engine.

As can be seen by viewing the transient top dead center position of the crank 55 in FIG. 7, it is below the programmed top dead center for long stroke TDCL. The microprocessor senses this phase retardation by signals from encoder 95 and compares them with preprogrammed values for piston top dead center long stroke and in response to this comparison derives control signals for the servomotor 65 to rotate its output pinion 76 in a clockwise direction as seen in FIG. 4 to raise the top dead center of crank 55 to the preprogrammed position as indicated by the angle $\beta$ in FIG. 8.

Figure 9:
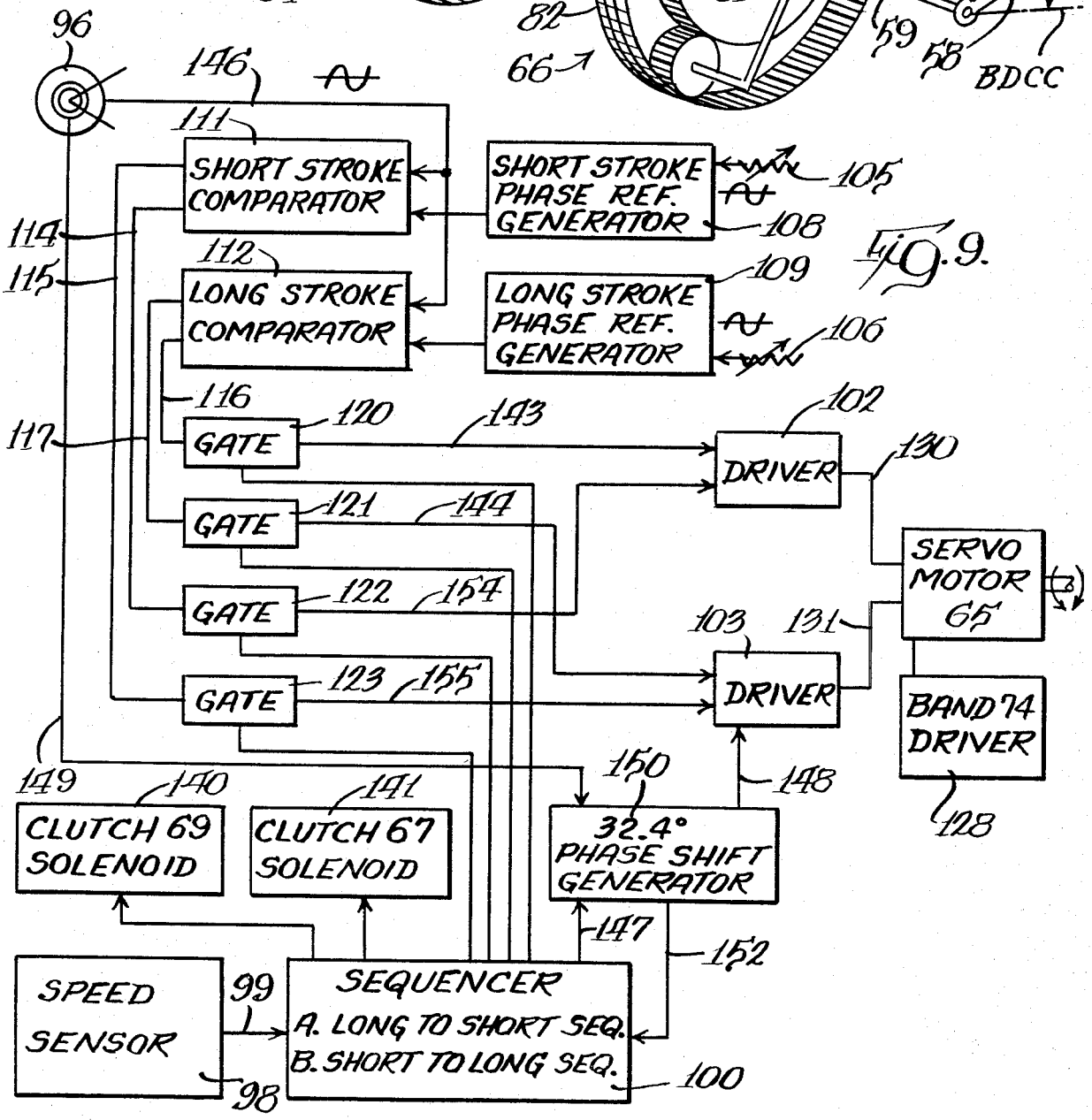

Referring to FIG. 9, a microprocessor is shown in diagrammatic form for controlling the clutch 69, band brake 67, both associated with the second stage planetary gear set 66, and servo-motor 65 and band brake 74 associated with the first planetary gear set 64. The microprocessor takes the form of an integrated circuit panel adapted to be mounted in a convenient location adjacent the internal combustion engine, and it responds to two inputs, namely the encoder 95 which develops control signals proportional to the phase of oscillation of the input shaft 20 as described in connection with FIG. 4, a speed sensor 98 which provides signals in line 99 to sequencer 100 representative of the speed of output shaft 22 or the speed of one of the load elements driven thereby. Preprogrammed values for the desired phase or top dead center of the piston are manually applied to potentiometers 105 and 106, controlling and biasing a short stroke reference phase generator 108 and a long stroke reference phase generator 109. By varying these preprogrammed values the top dead center positions of the pistons may be varied in both long and short stroke to change the engine compression ratio to accommodate different fuels. The reference phase generators 108 and 109 generate output signals that are alternating signals phase shifted from a predetermined reference, and apply them to a short stroke comparator 111 and a long stroke comparator 112. Comparators 111 and 112 compare the signals from reference generators 108 and 109 with the phase responsive signals from the encoder 95 to provide differential signals in lines 114, 115, 116 and 117. Line 114 applies positive phase or clockwise signals to clockwise servo-driver 102 through gate 122, and line 115 applies negative phase or counterclockwise signals to counterclockwise servo-driver 103 through gate 123, both being outputs from short stroke comparator 111. The long stroke comparator 112 supplies positive phase or clockwise control signals in line 116 to servo-driver 102 through gate 120, and applies negative phase or counterclockwise control signals to servo-driver 103 in line 117 through gate 121.

A driver 128 for band brake 74 deactuates band brake 74 by responding to signals in either output lines 130 and 131 from servodrivers 102 and 103. When signals cease in lines 130 and 131 indicating proper positioning of first stage ring gear 73, then driver 128 is deactuated releasing band brake 74 to its clamping position, immobilizing ring gear 73.

The microprocessor includes a sequencer 100 for controlling the long to short stroke sequence as well as the short to long stroke sequence. Sequencer 100 responds to speed sensor 98 which is a conventional speed rotation sensor connected to sense rotation of output shaft 22 or a load element driven by the output shaft.

In response to an increase in speed to a desired low speed shift point, sequencer 100 senses this condition from signals applied in line 99 from the speed sensor, and actuates clutch solenoid 140 which engages clutch 69 and deactuates brake solenoid 141 to release band brake 67 on ring gear 82. The drive 13 then shifts to short stroke. Immediately thereafter, sequencer 100 activates gates 122 and 123 to apply positive phase or negative phase short stroke control signals in lines 154 and 155 to servo-drivers 102 and 103 to control the direction of rotation of the servo-motor 65 and at the same time energize band brake driver 128, associated with band 74, which releases the band from ring gear 73. As servo-motor 65 rotates ring gear 73 in a direction depending upon whether positive phase signals appear in line 154 or negative phase signals appear in line 155, the phase of oscillation of shaft 20 will shift providing a phase shift in the signal from encoder 95 to the short stroke comparator in line 146 reducing the phase difference in short stroke comparator 111 and reducing the output signals in one of lines 114 and 115, until comparator 111 senses no phase difference and at that time signals in lines 114 or 115 will cease and drivers 102 or 103 will have no output thereby stopping servo-motor 65 and at the same time deenergizing band brake driver 128 actuating band 74 to clamp ring gear 73 in the adjusted position.

In shifting from short stroke back to long stroke, the sequencer 100 responds to a predetermined decrease in speed from sensor 98 through line 99, to provide a start function signal in line 147 to a phase shift generator 148 that applies an output signal to reverse or counterclockwise driver 103 through line 148. The phase shift generator responds to the encoder 95 through line 149 to reduce the value of the output signal applied to driver 103 until crank 55 has been retarded from top dead center short stroke approximately 32.4 degrees. When this is completed phase shift generator 150 applies an end of function signal through line 152 to sequencer 100, and in response to the presence of this signal, sequencer 100 deactuates clutch solenoid 140 to disengage clutch 69, and actuates brake solenoid 141 clamping band brake 67 and immobilizing second stage ring gear 82, placing the drive 13 in the long stroke mode.

Immediately thereafter sequencer 100 provides signals to gates 120 and 121 to gate the long stroke control signals from long stroke comparator 116 to servo-drivers 102 and 103 through lines 143 and 144, and long stroke comparator 112, in response to the preprogrammed values for long stroke phase in phase reference generator 109 and to feedback signals from encoder 95, controls servo-motor 65 to shift the top dead center position to the preprogrammed value for long stroke operation in the same manner described above in connection with long stroke to short stroke shifting.

In an alternate form of the internal combustion engine illustrated in FIG. 1 and not shown in the drawings, the pistons 118 and 119 can drive rocker-crank mechanism 27 through the gear drive 13, eliminating the requirement for the second gear drive 14. In this embodiment input shaft 20 is drivingly connected to input shaft 25 through a sun gear connected to the right end of shaft 20 and drivingly engaged with planet pinions carried by a planet carrier fixed to the left end of the input shaft 25. The ratio of the diameter of the sun gear to the diameter of the pinion planets is four to one so that shafts 20 and 25 oscillate through the same arc 180 degrees out of phase. Rocker crank mechanism 27, rather than being connected to the output from planetary gear drive 14, is drivingly connected to output sleeve 59 adjacent rocker-crank mechanism 24 with the crank arms 58 being diametrically opposed on opposite sides of the shaft so that the rocker-crank mechanisms 24 and 27 would be 180 degrees out of phase as they are in the FIG. 1 embodiment.

I claim:

1. An internal combustion engine of the piston and cylinder type having valves for admitting fuel to the cylinder and exhausting the products of combustion, comprising; a cylinder, a piston reciprocable in the cylinder and having a stroke length with piston top dead center and piston bottom dead center positions, a crank driven by the piston rotationally mounted about an axis, an output shaft driven in rotation by the piston, means for varying the length of stroke of the piston as the engine is operating, and means for varying the top dead center position of the piston as the engine is operating without varying the length of stroke of the piston and without moving the rotational axis of the crank.

2. An internal combustion engine of the piston and cylinder type having valves for admitting fuel to the cylinder and exhausting the products of combustion, comprising; a cylinder, a piston reciprocable in the cylinder defining a combustion chamber having a long stroke between first top dead center and first bottom dead center positions, and a short stroke between second top dead center and second bottom dead center positions, an output shaft driven in rotation by the piston, means for sensing the speed of the output shaft, and variable drive connecting means between the piston and the output shaft responsive to the sensing means for shifting the piston from long stroke to short stroke in response to a predetermined increase in speed of said output shaft, including means responsive to the sensing means for shifting the top dead center position of the piston from the first top dead center position to a higher top dead center position substantially at the time the piston stroke shifts from long stroke to short stroke.

3. An internal combustion engine of the piston and cylinder type having valves for admitting fuel to the cylinder and exhausting the products of combustion, comprising; a cylinder, a piston reciprocable in the cylinder defining a combustion chamber having a long stroke between first top dead center and first bottom dead center positions, and a short stroke between second top dead center and second bottom dead center positions, an output shaft driven in rotation by the piston, means for sensing the speed of the output shaft, said cylinder having a head end and defining with the piston in top dead center a clearance volume therebetween, means responsive to the sensing means and the speed of the output shaft for shifting the piston stroke from long stroke to short stroke, and means responsive to the speed of the output shaft for raising the top dead center position of the piston and decreasing the clearance volume as the piston stroke is shifted from long stroke to short stroke.

4. An internal combustion engine of the piston and cylinder type having valves for admitting fuel to the cylinder and exhausting the products of combustion, comprising; a cylinder, a piston slideable in the cylinder and having a piston top dead center position and a piston bottom dead center position defining therebetween a piston stroke length, an output shaft adapted to be driven in rotation by the piston, an input shaft connected to be driven in oscillation by the piston, planetary gearing driven in oscillation without 360 degree rotation by the input shaft including input gearing, output gearing and reaction gearing for controlling the angle of oscillation of the input gearing relative to the output gearing, and control means for the reaction gearing for varying the top dead center position of the piston without varying the piston stroke length.

5. An internal combustion engine of the piston and cylinder type having valves for admitting fuel to the cylinder and exhausting the products of combustion, comprising; a cylinder, a piston slideable in the cylinder and having a piston top dead center position and a piston bottom dead center position defining therebetween a piston stroke length, an output shaft adapted to be driven in rotation by the piston, means for sensing the speed of the output shaft, means to vary the length of stroke of the piston from a predetermined long stroke to a predetermined short stroke as the engine is operating in response to a predetermined increase in speed of the output shaft determined by the sensing means, and means responsive to the speed of the output shaft to raise the top dead center position of the piston substantially at the time the length of stroke is shifted from long stroke to short stroke to maintain a substantially constant compression ratio in the long stroke and the short stroke.

6. An internal combustion engine of the piston and cylinder type having valves for admitting fuel to the cylinder and exhausting the products of combustion, comprising; a cylinder, a piston slideable in the cylinder and having a piston top dead center position and a piston bottom dead center position defining therebetween a piston stroke length, an output shaft adapted to be driven in rotation by the piston, means for sensing the speed of the output shaft, means to increase the length of stroke of the piston from a predetermined short stroke to a predetermined long stroke in response to a predetermined decrease in engine speed determined by the sensing means, means to lower the piston top dead center position of the piston prior to shift from the long stroke to the short stroke, and means for raising the top dead center position of the piston after shifting from the short stroke to the long stroke to maintain a substantially constant compression ratio in both the short stroke and the long stroke.

7. An internal combustion engine of the piston and cylinder type having valves for admitting fuel to the cylinder and exhausting the products of combustion, comprising; a cylinder, a piston reciprocable in the cylinder and having a stroke length with piston top dead center and piston bottom dead center positions, a piston rod pivotally connected to the piston at one end, a crank arm pivotally connected at one end to the piston rod at the other end thereof, an output shaft fixed to the other end of the crank and driven thereby, means for increasing the length of stroke of the piston as the engine is operating without raising the piston top dead center position, said means for increasing the length of stroke of the piston as the engine is operating without raising the piston top dead center position including means for lowering the piston top dead center position prior to increasing the length of stroke of the piston, and means for raising the top dead center position of the piston after the length of stroke has been increased.

8. An internal combustion engine of the piston and cylinder type having valves for admitting fuel to the cylinder and exhausting the products of combustion comprising; a cylinder, a piston slideable in the cylinder and having a piston top dead center position and a piston bottom dead center position defining therebetween a piston stroke length, an output shaft adapted to be driven in rotation by the piston, an input shaft connected to be driven in oscillation without rotation by the piston, planetary gearing driven by the input shaft in oscillating non-360 degree movement including input gearing, output gearing, and reaction gearing for controlling the angle of oscillation of the input gearing relative to the output gearing, an output shaft driven by the output gearing, and control means for the reaction gearing to vary the stroke length of piston.

9. An internal combustion engine as defined in claim 8, wherein the control means for the planetary gearing includes means for selectively locking the reaction gearing against oscillating and locking the reaction gearing to oscillate with the output gearing.

10. An internal combustion engine as defined in claim 8, including second planetary gearing including an input gear driven by the oscillating input shaft, output gear drivingly connected to the input gearing of the first planetary gearing, and a reaction gear for controlling the phase of the angle through which the input shaft oscillates, and control means for the second planetary gearing reaction gear to vary the top dead center position of the piston without varying the piston stroke length.

11. An internal combustion engine as defined in claim 10, wherein the control means for the second planetary gearing includes means for incrementally adjusting the angular position of the reaction gear.

12. An internal combustion engine as defined in claim 10, wherein the second planetary gearing includes a planet carrier driven by the input shaft having a plurality of planets carried thereby, said reaction gear being a ring gear engaging the planets, said input gear being a sun gear engaging said planets, said control means for the second planetary gearing including a servo-motor for incrementally angularly positioning the ring gear, said first planetary gearing including sun gearing driven by the sun gear, said output gearing being a planetary gearing carrier having pinions engaging said sun gearing, said reaction gearing being ring gearing engaging said planetary gearing carrier planets, said control means for the first planetary gearing including a clutch for selectively locking the ring gearing to the planetary gearing carrier, and crank means driven by the oscillating planetary gearing carrier for driving the engine output shaft in rotation.

* * * * *